US005755239A

United States Patent [19]

Baltierra

[11] Patent Number: 5,755,239

[45] Date of Patent: May 26, 1998

[54] PTERYGIUM SPADE MANICURING APPLIANCE

[76] Inventor: Julie Baltierra, 275 E. 18th St. No. 45, Costa Mesa, Calif. 92627

[21] Appl. No.: 634,290

[22] Filed: Apr. 18, 1996

[51] Int. Cl.[6] ..... A45D 29/16

[52] U.S. Cl. ..... 132/73; 30/26

[58] Field of Search ..... 132/73, 73.5, 75.4; 30/26, 169

[56] References Cited

U.S. PATENT DOCUMENTS

| | | | |
|---|---|---|---|
| D. 152,708 | 2/1949 | Levnaich | 132/73 |
| 606,937 | 7/1898 | Pancoast | 132/74.5 |
| 1,855,063 | 4/1932 | Lovette | 132/74.5 |
| 2,513,208 | 6/1950 | Rogers | 132/73 |
| 2,888,020 | 5/1959 | Schultz | 132/73.5 |
| 4,559,957 | 12/1985 | Hokama | 132/73 |
| 4,930,529 | 6/1990 | Whitney | 132/73 |

FOREIGN PATENT DOCUMENTS

| | | | |
|---|---|---|---|
| 52050 | 5/1982 | European Pat. Off. | 132/73 |
| 907702 | 3/1946 | France | 30/26 |
| 3321352 | 12/1983 | Germany | 132/73.5 |
| 299497 | 10/1928 | United Kingdom | 30/26 |

*Primary Examiner*—Todd E. Manahan
*Attorney, Agent, or Firm*—Leonard Tachner

[57] ABSTRACT

A manicuring apparatus in the form of an elongated spade which serves two distinct functions. One such function is pushing and separating the cuticle and the other such function is removing the pterygium membrane with a scraping action. The pterygium membrane is a thin layer of skin firmly attached to and extending over the nail plate from the cuticle. The appliance comprises a handle portion and a dome portion, the latter terminating in an arcuate blade edge shaped to conform to the curvature of the cuticle edge of the nail.

7 Claims, 4 Drawing Sheets

PTERYGIUM SPADE MANICURING APPLIANCE

BACKGROUND OF THE INVENTION

1. Field of the Invention

The present invention pertains generally to the field of manicuring appliances and more specifically to a manicuring spade used to both push back the cuticle and remove the pterygium membrane adjacent the cuticle.

2. Prior Art

Although there are a variety of manicuring appliances which may be used for pushing back the cuticle, none known to the Applicant herein is both capable of that particular function and the function of pterygium membrane removal by being shaped to provide pushing and removing capabilities in one convenient tool adapted for firm gripping and control.

SUMMARY OF THE INVENTION

The present invention comprises an elongated spade having a handle portion and a dome portion, the latter terminating in an arcuate blade edge shaped to conform to the curvature of the cuticle edge of the nail. The dome portion is designed to both push back the cuticle and remove the pterygium membrane adjacent the cuticle. The handle portion has a partially ribbed surface and a neck region for firm gripping and control. The dome portion has a neck region for improved visibility of the nail during manicuring operations to minimize the possibility of injury. The blade edge is designed to scrape and remove the pterygium membrane from the nail plate after the face of the dome portion pushes back the cuticle to allow access to the membrane.

OBJECTS OF THE INVENTION

A principal object of the present invention is to provide a manicuring appliance specifically designed to both push back the cuticle and remove the pterygium membrane.

Another object of the present invention is to provide a spade-like tool for manicuring.

Still another object of the present invention is to provide a pterygium spade manicuring appliance which is simple to produce, easy to hold and maneuver and which permits safe removal of the pterygium membrane along the cuticle edge of the fingernail.

Still another object of the present invention is to provide a sharp edged manicuring instrument which conforms along its scraping edge to the arcuate shape of the cuticle/nail interface for removal of the pterygium membrane.

BRIEF DESCRIPTION OF THE DRAWINGS

The aforementioned objects and advantages of the present invention as well as additional objects and advantages thereof will be more fully understood hereinafter as a result of a detailed description of a preferred embodiment of the invention when taken in conjunction with the following drawings in which:

FIG. 2, comprising

DETAILED DESCRIPTION OF A PREFERRED EMBODIMENT

Figure 1:
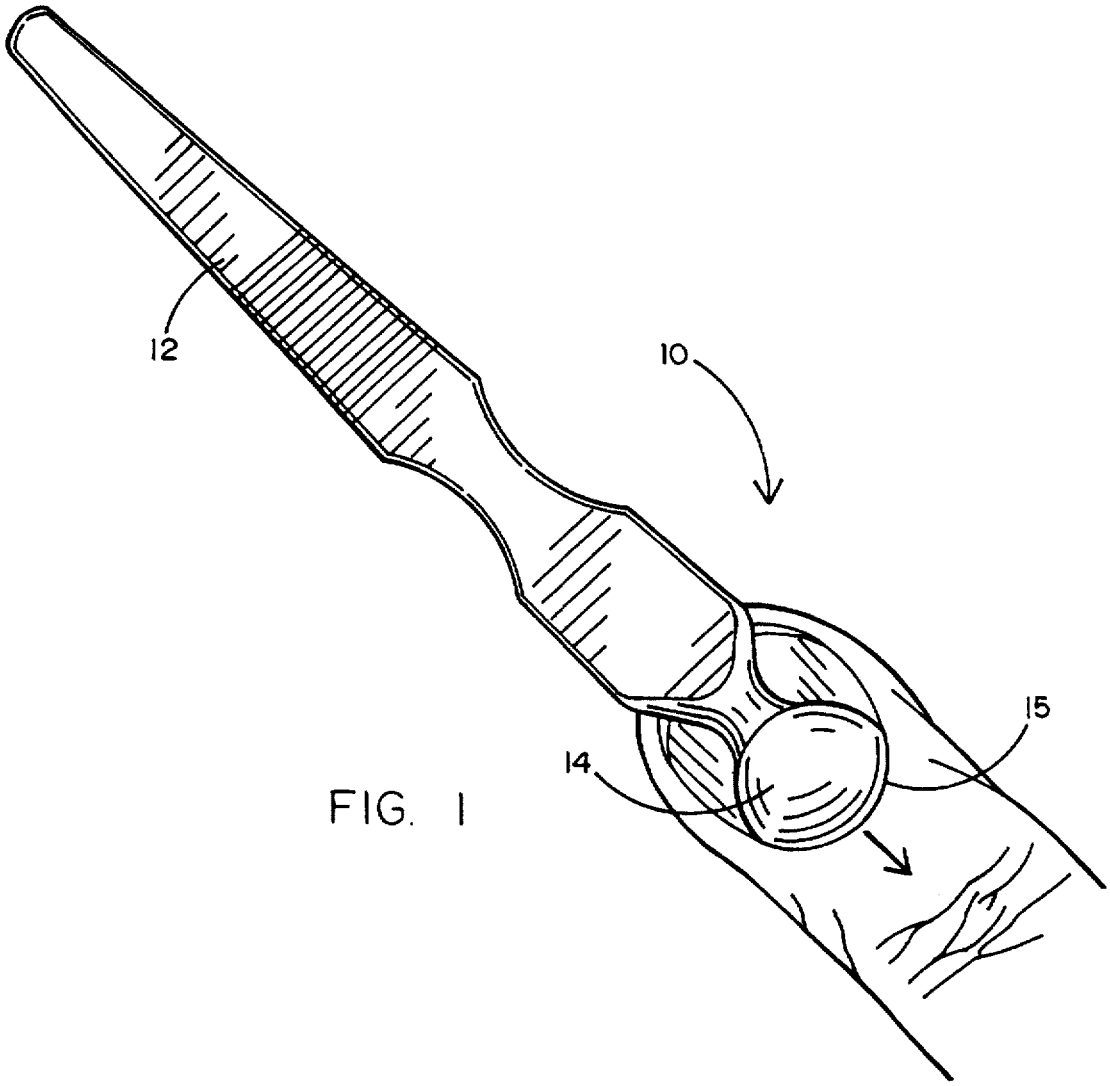
FIG. 1 is a top view of the invention shown in relation to a fingernail.

Referring to the accompanying figures, it will be seen that the pterygium spade 10 of the present invention comprises a handle portion 12 and integral dome portion 14, the latter terminating in a preferrably arcuate-shaped sharp blade edge 15. The arcuate-shaped blade edge 15 is designed to generally conform to the curvature of the cuticle/nail interface of typical fingernail configurations. A first neck region 16 is provided along with a ribbed surface 20 to increase ease of gripping the handle portion 12. A second neck region 18 is provided between the handle portion 12 and the dome portion 14. Neck region 18 increases visibility thus decreasing the risk of injury. The dome portion 14 preferrably forms an angle of from 45 to 90 degrees with the handle portion 12. The handle portion is substantially straight and has a substantially rectangular cross-section. The arcuate blade edge 15 is sufficiently sharp to cut through and scrape off the pterygium membrane of the fingernail without undue pressure. The spade 10 may be made of an injection molded plastic that is sufficiently rigid to retain its shape during manicuring operations. Of course, the spade can also be made of virtually any generally available commercial metal such as steel or aluminum, as well as their alloys.

Figure 2A:
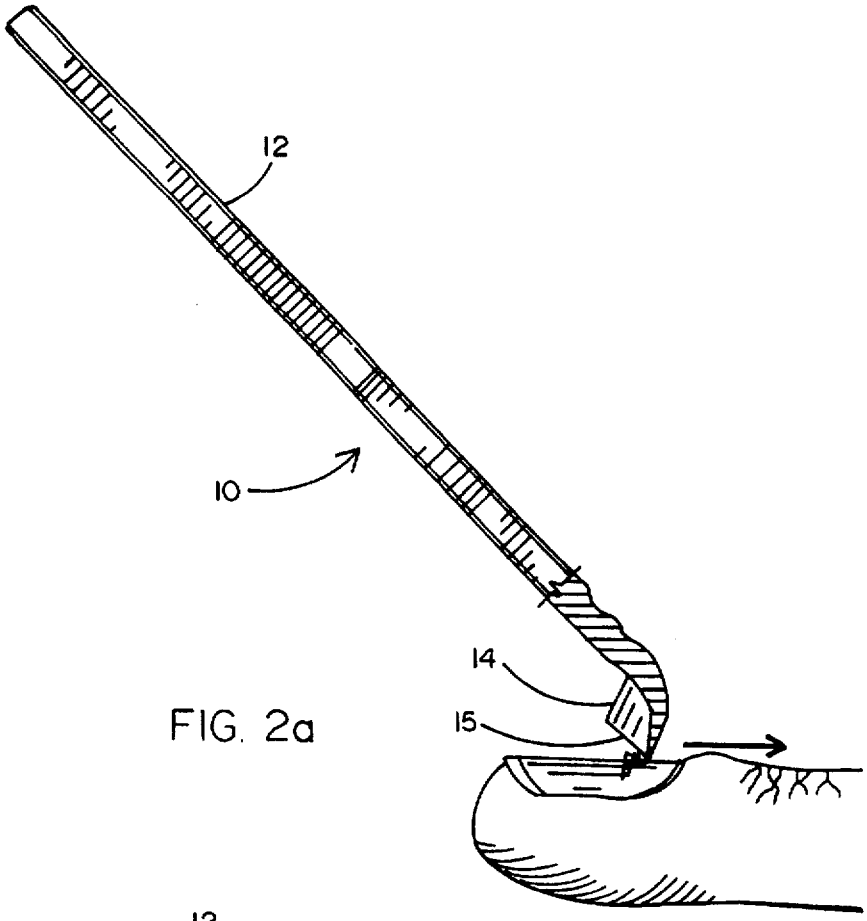
FIGS. 2*a* and 2*b*, is a side view of the invention shown in relation to a fingernail and illustrating the cuticle pushing position in FIG. 2*a* and the pterygium membrane scraping position in FIG. 2*b;*
Figure 2B:
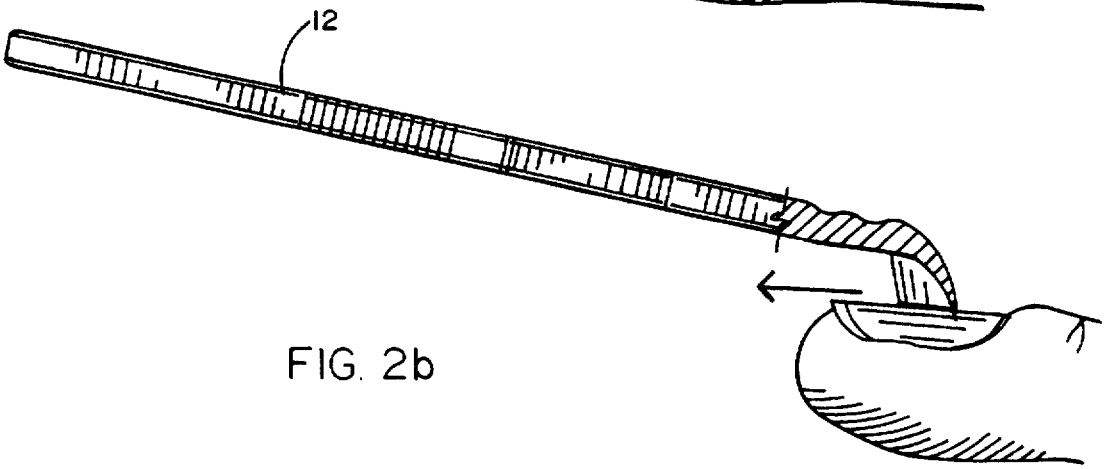
Figure 3:
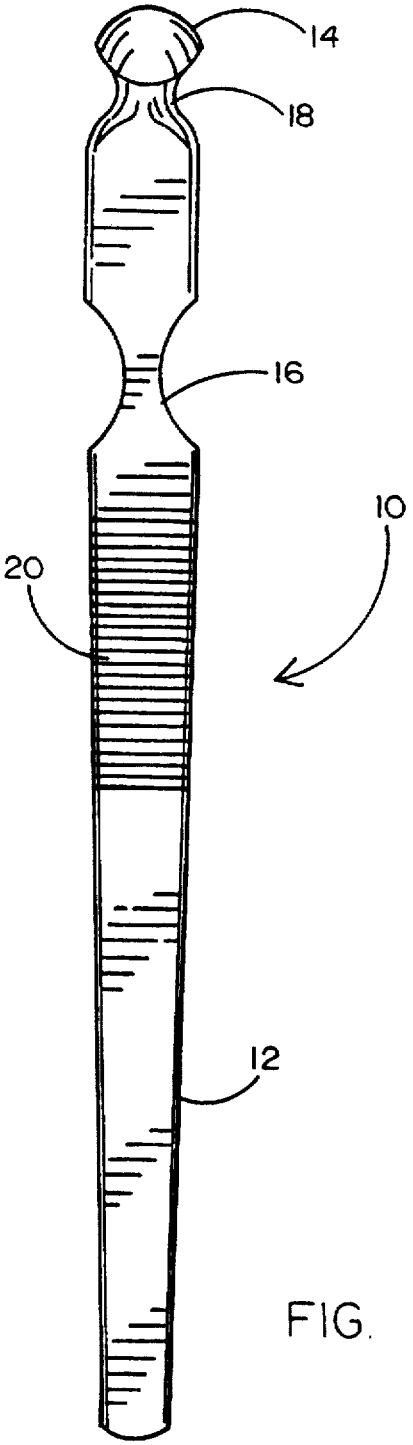
FIG. 3 is a top view of the invention.
Figure 4:
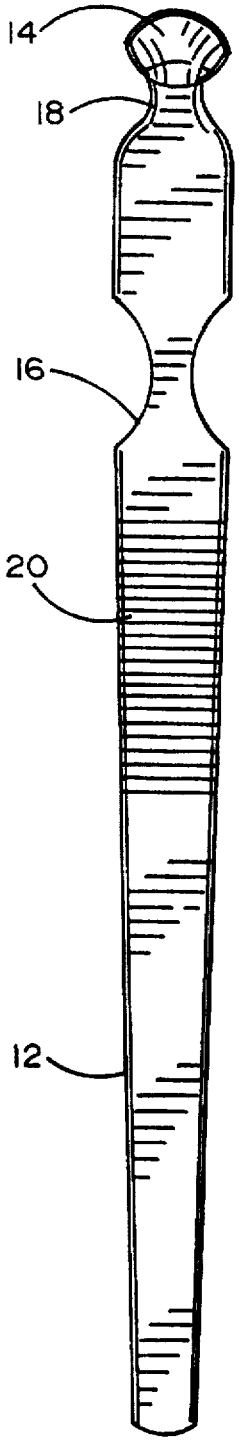
FIG. 4 is a bottom view of the invention.
Figure 5:
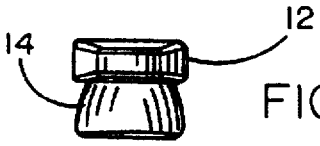
FIG. 5 is a first end view of the invention.
Figure 6:
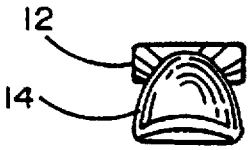
FIG. 6 is a second end view of the invention.
Figure 7:
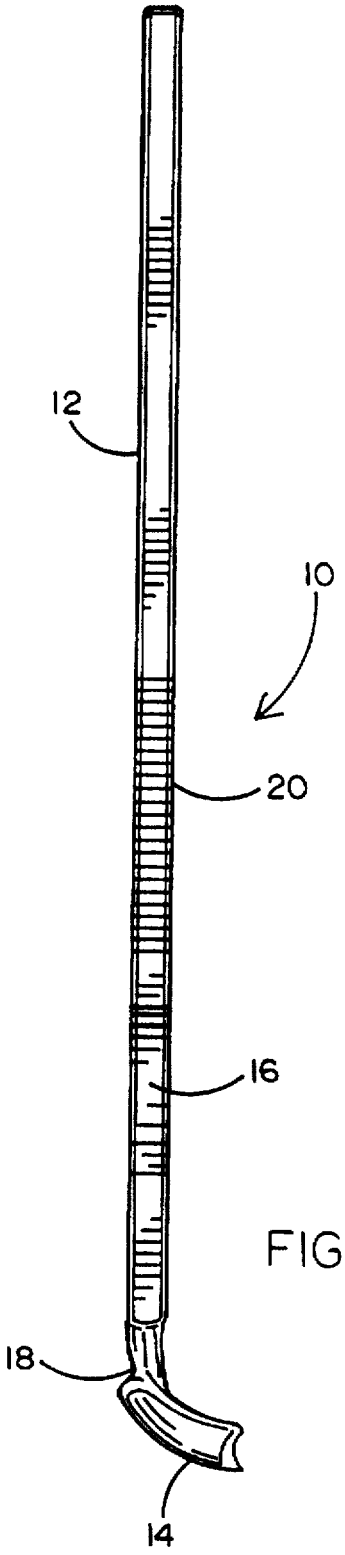
FIG. 7 is a first side view of the invention.
Figure 8:
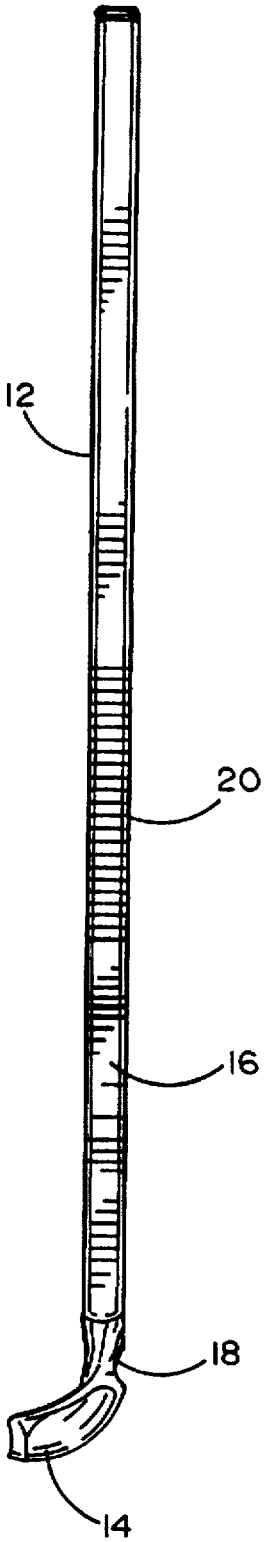
FIG. 8 is a second side view of the invention.

The spade 10 is uniquely designed to perform two distinct, yet related functions. When the spade is positioned at about 45 degrees above the surface of the nail plate as shown in FIG. 2*a*, it is configured for pushing back the cuticle. The convex surface of the dome portion 14 adjacent the blade edge 15 is used to carry out this cuticle-pushing function. Pushing back the cuticle permits access to the pterygium membrane. The spade is then positioned at about 10 degrees above the nail plate surface as shown in FIG. 2*b*. In this position, the spade is configured to scrape the pterygium membrane as the edge 15 is pulled back from the cuticle. Because of the sharp blade shape of edge 15, scraping is accomplished with little downward force which would otherwise damage the top layer of the nail plate. Removal of the pterygium membrane is especially advantageous for preparing the nail plate to receive an acrylic nail product.

Those having skill in the manicuring arts will now understand that the present invention comprises a pterygium spade having an elongated handle portion and an integral dome portion, the latter terminating in an arcuate sharp blade edge shaped to generally conform to the cuticle/nail interface of a fingernail. The inventive spade is configured for both pushing back the cuticle and then scraping off the pterygium membrane from the nail plate.

I claim:

1. A manicure appliance comprising:

an elongated spade having a handle portion and a dome portion, the dome portion terminating in an arcuate blade edge shaped to substantially conform to the curvature of the cuticle edge of the human fingernail;

wherein said dome portion forms an angle of from 45 degrees to 90 degrees with respect to said handle portion;

wherein said arcuate blade edge is sufficiently sharp to scrape off the pterygium membrane of said fingernail.

2. The appliance recited in claim 1 wherein said handle portion comprises a neck region for gripping said appliance.

3. The appliance recited in claim 1 wherein said dome portion comprises a neck region adjacent said handle portion.

4. The appliance recited in claim 1 wherein said handle portion comprises a ribbed surface for gripping said appliance.

5. The appliance recited in claim 1 wherein said handle portion is substantially straight and has a substantially rectangular cross-section.

6. A manicure appliance comprising:

an elongated spade having a handle portion and a dome portion, the dome portion terminating in an arcuate blade edge shaped to substantially conform to the curvature of the cuticle edge of the human fingernail;

said handle portion having a neck region for gripping said appliance; and said dome portion having a neck region adjacent said handle portions;

wherein said dome portion forms an angle of from 45 degrees to 90 degrees with respect to said handle portion;

wherein said arcuate blade edge is sufficiently sharp to scrape off the pterygium membrane of said fingernail.

7. A manicure appliance comprising:

an elongated spade having a handle portion and a dome portion, the dome portion terminating in an arcuate blade edge shaped to substantially conform to the curvature of the cuticle edge of the human fingernail;

said dome portion forming an angle of from 45 degrees to 90 degrees with respect to said handle portion; and said handle portion being substantially straight and having a substantially rectangular cross-section;

wherein said arcuate blade edge is sufficiently sharp to scrape off the pterygium membrane of said fingernail.

* * * * *